United States Patent [19]

Bobsein et al.

[11] Patent Number: 4,663,082

[45] Date of Patent: May 5, 1987

[54] WATER-BASED INDUSTRIAL CLEANERS

[75] Inventors: Rex L. Bobsein; Clarence R. Bresson, both of Bartlesville, Okla.

[73] Assignee: Phillips Petroleum Company, Bartlesville, Okla.

[21] Appl. No.: 808,971

[22] Filed: Dec. 16, 1985

[51] Int. Cl.[4] ..... C11D 1/755; C11D 3/075

[52] U.S. Cl. ..... 252/530; 252/89.1; 252/174.21; 252/174.22; 252/546; 252/549

[58] Field of Search ..... 252/530, 549, 174.21, 252/174.22, 546, 59.1; 568/27, 32

[56] References Cited

U.S. PATENT DOCUMENTS

| | | | |
|---|---|---|---|
| 2,864,866 | 12/1958 | Louthan | 568/32 |
| 3,336,230 | 8/1967 | Lyness et al. | 252/530 |
| 3,627,845 | 12/1971 | Hickner et al. | 252/549 |
| 3,660,497 | 5/1972 | Priestley et al. | 252/549 |
| 3,984,480 | 10/1976 | Vanlerberghe et al. | 252/549 |
| 3,988,377 | 10/1976 | Lamberti et al. | 252/530 |
| 4,009,211 | 2/1977 | Onopchenko et al. | 252/549 |

*Primary Examiner*—Prince E. Willis

*Attorney, Agent, or Firm*—J. Michael Simpson

[57] ABSTRACT

A stable water-based industrial cleaning composition comprising water, an additive comprising a mixture of an alkyl polyoxyalkylene sulfide and an alkyl polyoxyalkylene sulfoxide and at least one builder selected from the group consisting of alkali metal and ammonium salts of ethylenediamine tetraacetic acid, alkali metal and ammonium pyrophosphates, alkali metal and ammonium metasilicates, alkali metal hydroxides, alkaline earth metal hydroxides and alkali metal borates is disclosed. In accordance with the invention, said alkyl polyoxyalkylene sulfide may be partially oxidized to its corresponding alkyl polyoxyalkylene sulfoxide to produce said additive.

50 Claims, 4 Drawing Figures

WATER-BASED INDUSTRIAL CLEANERS

This invention relates to water-based industrial cleaners. In another aspect, this invention relates to a method for improving the stability of a water-based industrial cleaner.

Although many cleaning compositions are known in the art as being useful in the industrial cleaning of solid surfaces such as metal or rubber, many of these cleaning compositions contain organic solvents, such as chlorinated paraffins and kerosene, which can be both flammable and potentially harmful to the user. In addition, the disposal of such organic solvents presents a problem in that they are generally considered to be environmental contaminants.

It is therefore desirable to provide an industrial cleaning composition that is nonflammable, nonhazardous for the user and noncontaminative of the environment. Such an industrial cleaning composition was disclosed in U.S. Pat. No. 2,864,866. The cleaning composition disclosed in this patent comprised water and an additive comprising an alkyl polyoxyalkylene sulfoxide. Although this cleaning composition is an effective water-based industrial cleaner, it has been discovered that the alkyl polyoxyalkylene sulfoxide additive is unstable and will rapidly decompose to form an oil layer when separately stored.

Thus, it is an object of this invention to provide a stable water-based industrial cleaning composition that is nonflammable, nonhazardous and noncontaminative of the environment. It is a further object of this invention to provide a method for improving the stability of the alkyl polyoxyalkylene additive used in the water-based cleaning composition set forth above. The term "stable" and its related forms, as used herein, refers to a composition's ability to produce no observable oil formation in long term oven tests.

In accordance with the present invention, a stable water-based industrial cleaning composition is prepared by combining a mixture of an alkyl polyoxyalkylene sulfide and an alkyl polyoxyalkylene sulfoxide with water and at least one builder selected from the group consisting of alkali metal and ammonium salts of ethylenediamine tetraacetic acid, alkali metal and ammonium pyrophosphates, alkali metal and ammonium metasilicates, alkali metal hydroxides, alkaline earth metal hydroxides and alkali metal borates.

In accordance with one embodiment of this invention, said mixture of an alkyl polyoxyalkylene sulfide and an alkyl polyoxyalkylene sulfoxide is prepared by the partial oxidation of said alkyl polyoxyalkylene sulfide to said alkyl polyoxyalkylene sulfoxide.

In an alternate embodiment of this invention, the stability of an alkyl polyoxyalkylene sulfoxide additive for a water-based industrial cleaning composition is improved by combining said alkyl polyoxyalkylene sulfoxide with an alkyl polyoxyalkylene sulfide to form a mixture of the two.

Other objects and advantages of the invention will be apparent from the foregoing brief description of the invention and the appended claims as well as the detailed description of the invention which follows.

The drawings, which are utilized to present data from the Examples discussed hereinafter, are briefly described as follows.

Figure 3:
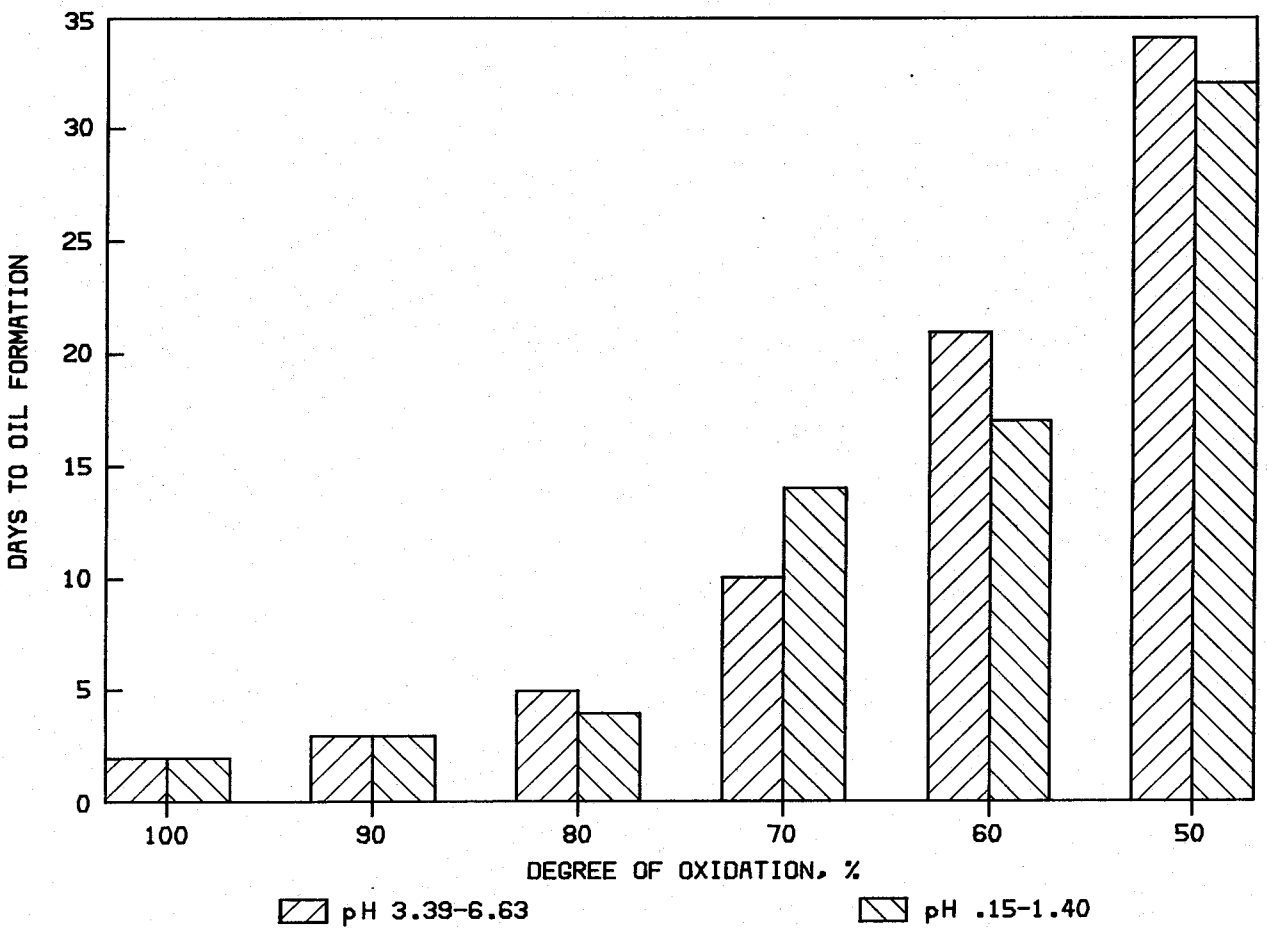
Figure 4:
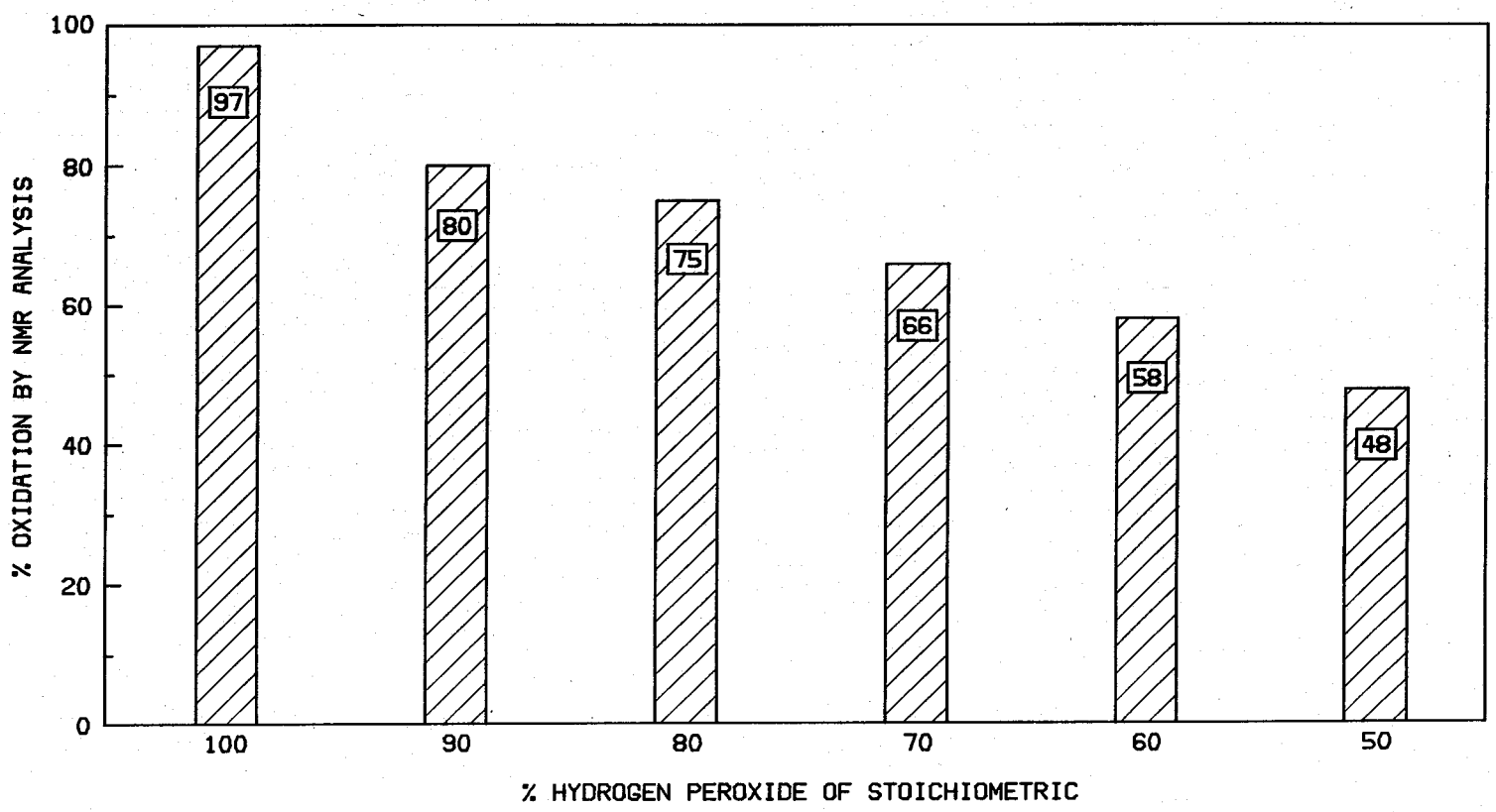

FIG. 3 is a graphical presentation of data from Example IIA which demonstrates the correlation between a solution's degree of oxidation and the number of days required for the solution to produce an oil layer in heated oven tests; and FIG. 4 is a graphical presentation of data from Example IIB which demonstrates the correlation between a solution's degree of oxidation, as determined by NMR analysis, and the amount of hydrogen peroxide employed in the oxidation reaction.

The water-based industrial cleaning composition of this invention comprises water, an additive and a builder. The additive comprises a mixture of an alkyl polyoxyalkylene sulfide and an alkyl polyoxyalkylene sulfoxide. Any suitable alkyl polyoxyalkylene sulfide may be used in accordance with this invention. Suitable alkyl polyoxyalkylene sulfides may be prepared by the reaction of an alkyl mercaptan and an alkylene oxide. A generic formula for a suitable alkyl polyoxyalkylene sulfide is as follows:

$$R-S-(R'O)_x-H$$

wherein R is a hydrocarbyl group having 1 to 20 (preferably 12) carbon atoms; R′ is a hydrocarbyl group having 2 to 5 (preferably 2) carbon atoms; and x=1 to 15 (preferably 3 to 12).

Examples of suitable alkyl polyoxyalkylene sulfides include: t-dodecyl polyoxyethylene sulfide, n-dodecyl polyoxyethylene sulfide, decyl polyoxyethylene sulfide, eicosyl polyoxyethylene sulfide, dodecyl polyoxypropylene sulfide, tetradecyl polyoxypropylene sulfide, octadecyl polyoxypropylene sulfide, decyl polyoxybutylene sulfide, dodecyl polyoxybutylene sulfide and undecyl polyoxybutylene sulfide. A preferred alkyl polyoxyalkylene sulfide is t-dodecyl polyoxyethylene sulfide with seven (7) oxyethylene repeat units.

Any suitable alkyl polyoxyalkylene sulfoxide may be utilized in the cleaning composition of this invention. Suitable alkyl polyoxyalkylene sulfoxides may be prepared by the oxidation of suitable alkyl polyoxyalkylene sulfides. A generic formula for a suitable alkyl polyoxyalkylene sulfoxide is as follows:

$$R-\overset{\overset{\displaystyle O}{\|}}{S}-(R'O)_x-H$$

wherein R is a hydrocarbyl group having 1 to 20 (preferably 12) carbon atoms; R′ is a hydrocarbyl group having 2 to 5 (preferably 2) carbon atoms; and x=1 to 15 (preferably 3 to 12).

Examples of suitable alkyl polyoxyalkylene sulfoxides include: t-dodecyl polyoxyethylene sulfoxide, n-dodecyl polyoxyethylene sulfoxide, decyl polyoxyethylene sulfoxide, eicosyl polyoxyethylene sulfoxide, dodecyl polyoxypropylene sulfoxide, tetradecyl polyoxypropylene sulfoxide, octadecyl polyoxypropylene sulfoxide, decyl polyoxybutylene sulfoxide, dodecyl polyoxybutylene sulfoxide and undecyl polyoxybutylene sulfoxide. A preferred alkyl polyoxyalkylene sulfoxide is t-dodecyl polyoxyethylene sulfoxide with seven (7) oxyethylene repeat units.

The mixture comprising an alkyl polyoxyalkylene sulfide and an alkyl polyoxyalkylene sulfoxide may be formed in any suitable manner. In one embodiment of this invention, the alkyl polyoxyalkylene sulfide is combined with the preformed alkyl polyoxyalkylene sulfoxide to form said mixture. In this embodiment, the two components may be combined in any suitable manner and under any suitable conditions. Preferably, the alkyl polyoxyalkylene sulfide and the alkyl polyoxyalkylene sulfoxide are mixed together using conventional mixing equipment. It is not believed that the conditions of mixing, such as temperature and pressure, have any effect on the formation of the mixture.

In the preferred embodiment of this invention, the mixture comprising an alkyl polyoxyalkylene sulfide and an alkyl polyoxyalkylene sulfoxide is prepared by the partial oxidation of the alkyl polyoxyalkylene sulfide. The alkyl polyoxyalkylene sulfide may be partially oxidized in any suitable manner. Typically, the alkyl polyoxyalkylene sulfide is partially oxidized by contacting the sulfide, at a pH of less than seven (7), with an appropriate amount of an oxidizing agent in the presence of a catalytic acid under suitable oxidation conditions. Preferably, the alkyl polyoxyalkylene sulfide is neutralized to a pH of less than seven (7) by contacting the sulfide with the catalytic acid before contacting it with the oxidizing agent. The degree to which the alkyl polyoxyalkylene sulfide is oxidized to its corresponding sulfoxide may be regulated by altering the amount of oxidizing agent added to the oxidation reaction. The degree of oxidation may be determined by nuclear magnetic resonance (NMR) analysis. The degree of oxidation may also be determined by measuring the cloud point of the resulting solution; with a higher cloud point representing a greater degree of oxidation. The term "cloud point" as used herein refers to that temperature at which a substantially clear, 1% aqueous solution of said mixture, upon being heated, becomes cloudy due to the inverse temperature solubility of the mixture.

Any suitable oxidizing agent may be used in the oxidation process of this invention. Suitable oxidizing agents include hydrogen peroxide, sodium meta-periodate, peracetic acid, persulfuric acid, perboric acid and perbenzoic acid. Of these oxidizing agents, hydrogen peroxide is preferred.

Any suitable amount of said oxidizing agent may be added to the oxidation process of this invention. Typically, the amount of said oxidizing agent to be added to said reaction will be determined by the desired extent of oxidation. Preferably, the amount of said oxidizing agent added to the oxidation reaction will be in the range of about 30% to about 100% of stoichiometric. Most preferably, said amount will be in the range of about 50% to about 70% of stoichiometric.

Any suitable catalytic acid may be used in the oxidation process of this invention. Suitable catalytic acids include mineral acids such as sulfuric acid, hydrochloric acid, phosphoric acid, nitric acid, carbonic acid, hydrofluoric acid, and hydrobromic acid and organic acids such as acetic acid, propionic acid, butyric acid, oxalic acid, benzoic acid and malonic acid. Of these acids, sulfuric acid, hydrochloric acid and acetic acid are preferred. Sulfuric acid is the most preferred catalytic acid because it results in a greater degree of oxidation.

Any suitable amount of said catalytic acid may be used to neutralize said alkyl polyoxyalkylene sulfide. Typically, the amount of said catalytic acid used to neutralize the sulfide will be determined by what initial pH is desired for said sulfide. Preferably, a sufficient amount of said catalytic acid will be combined with said alkyl polyoxyalkylene sulfide to result in said sulfide having an initial pH in the range of about 0.15 to about 7.0. Most preferably, said initial pH will be in the range of about 1.0 to about 4.0.

The alkyl polyoxyalkylene sulfide may be partially oxidized to its corresponding sulfoxide under any suitable oxidation conditions. The alkyl polyoxyalkylene sulfide may be partially oxidized at any suitable temperature. The oxidation temperature will generally be in the range of about 50° F. to about 250° F. and will more preferably be in the range of about 100° F. to about 150° F. The alkyl polyoxyalkylene sulfide may be partially oxidized at any suitable pressure. The oxidation pressure will generally be atmospheric.

The alkyl polyoxyalkylene sulfide may be partially oxidized for any suitable length of time. Typically, the oxidation time will be that amount of time required for the oxidation reaction to consume the entire amount of the oxidizing agent present in the reaction. There are many methods known in the art which may be used to determine whether or not the oxidizing agent has been entirely consumed by the oxidation reaction. When hydrogen peroxide is used as the oxidizing agent, for example, a piece of lead acetate test paper which has been treated with hydrogen sulfide may be used to signal the completion of the oxidation reaction. If the test paper is bleached white upon coming in contact with the reaction solution then there is still an amount of hydrogen peroxide remaining in the solution. If the color of the test paper remains unchanged, however, then there are no peroxide radicals remaining in the solution and the oxidation reaction is complete.

Regardless of which of the foregoing embodiments is utilized to prepare the mixture, the stability of the industrial cleaning composition additive comprising an alkyl polyoxyalkylene sulfoxide will be improved by the presence of the alkyl polyoxyalkylene sulfide in the mixture.

Any suitable amount of the alkyl polyoxyalkylene sulfide may be present in said mixture. The concentration of the alkyl polyoxyalkylene sulfide in said mixture will generally be in the range of about 10 weight-% to about 90 weight-% based upon the weight of the mixture. Preferably, said concentration will be in the range of about 20 weight-% to about 80 weight-%, most preferably about 40 weight-%, based upon the weight of said mixture.

Any suitable amount of said mixture may be present in the cleaning composition of this invention. Typically, the concentration of said mixture in said cleaning composition will be in the range of about 1.0 weight-% to about 20 weight-% based upon the weight of said cleaning composition. Preferably, said concentration will be in the range of about 5.0 weight-% to about 10 weight-% based upon the weight of said cleaning composition.

Any suitable builder may be used, either alone or in combination with other suitable builders, in the cleaning composition of this invention. Suitable builders are those selected from the group consisting of alkali metal and ammonium salts of ethylenediamine tetraacetic acid, alkali metal and ammonium pyrophosphates, alkali metal and ammonium metasilicates, alkali metal hydroxides, alkaline earth metal hydroxides and alkali metal borates. Of these builders, the alkali metal salts of ethylenediamine tetraacetic acid, alkali metal pyrophosphates and alkali metal metasilicates are preferred. Most preferred among these builders is the sodium salt of ethylenediamine tetraacetic acid.

Any suitable amount of said builder may be present in the cleaning composition of this invention. Typically, the concentration of said builder in said cleaning composition will be in the range of about 1.0 weight-% to about 10 weight-% based upon the weight of said cleaning composition. Preferably, said concentration will be in the range of about 2.0 weight-% to about 4.0 weight-% based upon the weight of said cleaning composition.

Optionally, the cleaning composition of this invention may contain other traditional additives such as perfumes, dyes, corrosion inhibitors, rust inhibitors, soil redeposition agents and water soluble surfactants. These additives are well known in the art and do not play a part in this invention; therefore, they will not be more fully discussed hereinafter.

The components of the cleaning composition of this invention may be combined in any suitable manner and under any suitable conditions. Preferably, the components are mixed together using conventional mixing equipment. It is not believed that the conditions of mixing, such as temperature or pressure, have any effect on forming the mixture.

The cleaning composition of this invention may be used to clean any suitable industrial material. Suitable industrial materials include metal, rubber, glass, concrete, porcelin, ceramic tile, man-made polymers and other similar materials.

The cleaning composition of this invention may be used in any suitable manner to clean contaminated or heavily soiled industrial materials. Typically, said cleaning composition will be used in a vat or soak type cleaning system, which may be either agitated or non-agitated, or in a cleaning system wherein said cleaning composition is sprayed onto the surfaces of said materials. When an agitated vat or soak type cleaning system is employed, agitation may be provided by circulating pumps, stirrers and other similar devices.

The cleaning composition of this invention may be used to clean contaminated or heavily soiled industrial materials under any suitable conditions. Typically, the amount of time used to clean said materials will be in the range of about 30 seconds to about 12 hours. Preferably, the amount of time used to clean said materials will be in the range of about 1.0 hour to about 3.0 hours.

The cleaning composition of this invention may be used at any suitable temperature to clean said industrial materials. Generally, the cleaning temperature will be in the range of about 30° F. to about 200° F. Preferably said cleaning temperature will be in the range of about 60° F. to about 150° F. and will most preferably be about equivalent to the cloud point temperature of said cleaning composition.

The following examples are presented in further illustration of the invention.

EXAMPLE I

This example illustrates a number of water-based cleaning compositions which were prepared in accordance with this invention for evaluation. The cleaning compositions are described in Table I.

TABLE I

| Component | Formulation Number 1 | 2 | 3 | 4 | 5 | 6 |
|---|---|---|---|---|---|---|
| SPOE #17[a] | 50 g | 40 g | 30 g | 20 g | 10 g | 0 g |
| TPOE #17[b] | 0 g | 10 g | 20 g | 30 g | 40 g | 50 g |
| EDTA.4Na[c] | 30 g | 30 g | 30 g | 30 g | 30 g | 30 g |
| $H_2O$[d] | 920 g | 920 g | 920 g | 920 g | 920 g | 920 g |
| SPOE/TPOE | 100:0 | 80:20 | 60:40 | 40:60 | 20:80 | 0:100 |

[a] t-$C_{12}H_{25}$—S(O)—$(CH_2CH_2O)_7$—H; t-dodecyl polyoxyethylene sulfoxide also known as t-dodecyl sulfinylpolyoxyethylene (SPOE)
[b] t-$C_{12}H_{25}$—S—$(CH_2CH_2O)_7$—H; t-dodecyl polyoxyethylene sulfide also known as t-dodecyl thiopolyoxyethylene (TPOE)
[c] Tetrasodium salt of ethylenediaminetetraacetic acid, trihydrate from Aldrich Chemical Co.
[d] Distilled water

EXAMPLE IA

This example illustrates the use of the formulations prepared in Example I as cleaning compositions for used automobile parts. In this example, 900 mL of each formulation was charged to a one quart tin paint can. A piece of used valve cover measuring about 1½ inches by about 4 inches was then placed in each can. Each valve cover employed had a substantial dirty oil deposit on the outside of the cover and a substantial amount of varnish and dirt on the inside of the cover. The paint cans were then closed and placed upon a reciprocating shaker operating at 135–140 cycles per minute. After 20 hours upon the reciprocating shaker, the valve covers were removed from the paint cans and evaluated by three individual judges as to how well each formulation cleaned; a rating of one (1) representing the most clean and a rating of nine (9) representing the least clean. It should be noted that these evaluations are comparative and not absolute; thus, a rating of nine (9) does not indicate that the cleaning composition is ineffective as an industrial cleaner. Such a rating only indicates that the cleaning composition was a less effective industrial cleaner in comparison to the other cleaning compositions. The results of this evaluation are presented in Table II.

TABLE II

| Formulation | SPOE/TPOE | Ratings |
|---|---|---|
| 1 | 100:0 | 7 7 7 |
| 2 | 80:20 | 6 1 3 |
| 3 | 60:40 | 1 1 2 |
| 4 | 40:60 | 3 4 4 |
| 5 | 20:80 | 9 9 9 |
| 6 | 0:100 | 3 5 5 |

The test data presented in Table II demonstrates that a cleaning composition comprising a mixture of an alkyl polyoxyalkylene sulfide and an alkyl polyoxyalkylene sulfoxide is a better cleaner than a similar cleaning composition comprising only an alkyl polyoxyalkylene sulfoxide. The data also shows that a cleaning composition comprising said mixture in a ratio of 60% sulfoxide to 40% sulfide is preferred as the most effective cleaner.

EXAMPLE IB

Figure 1:
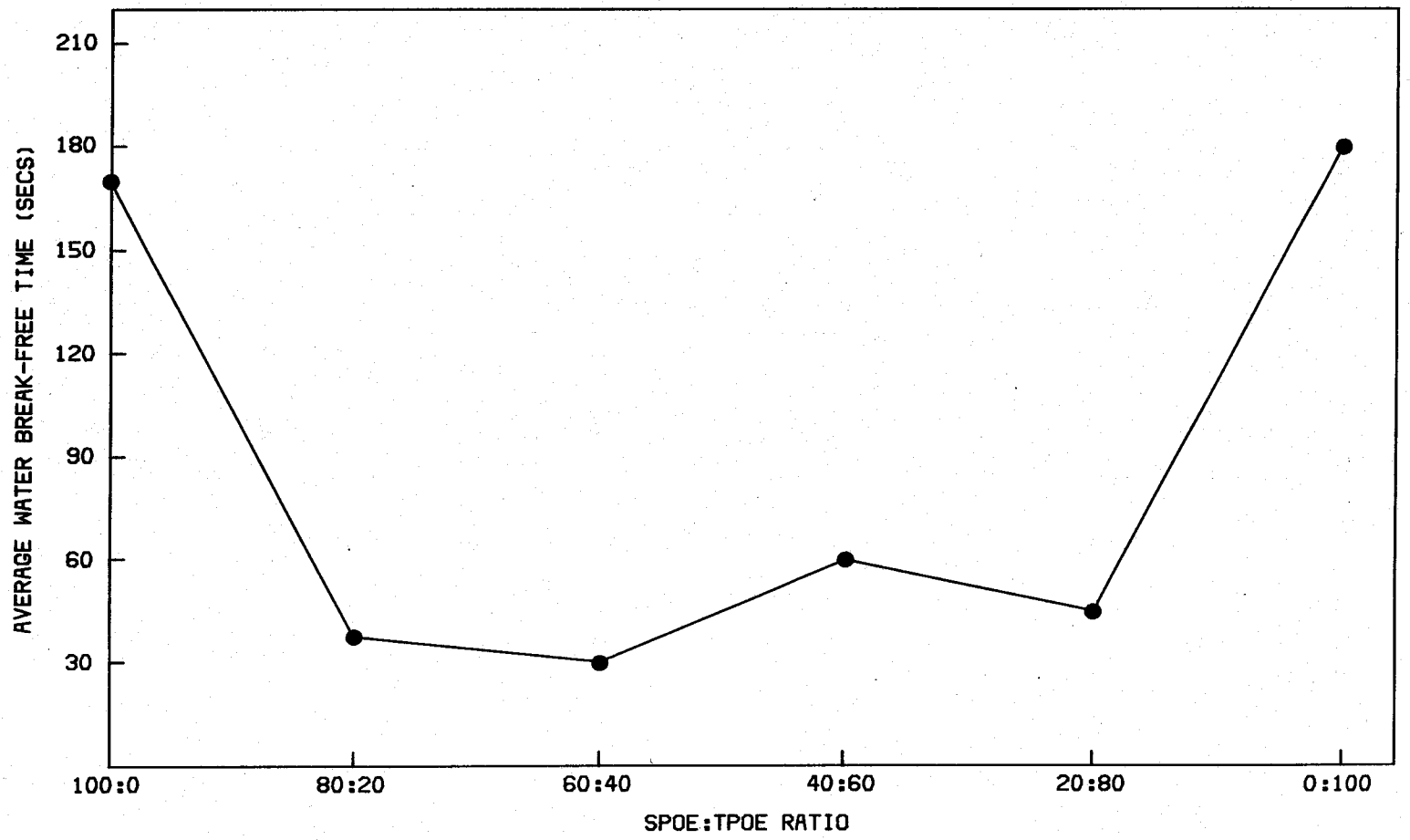
FIG. 1 is a graphical presentation of data from Example IB which demonstrates the correlation between water break-free time and the sulfoxide to sulfide ratio of the inventive mixture.

In this example, the formulations that were prepared in Example I are tested in a water break-free test. In this test, 800 mL of each formulation was placed in a stirred, temperature controlled ultrasonic bath. Finished carbon steel coil stock coupons measuring about one (1) inch by five (5) inches were then lightly wiped with a paper tissue, to remove excess oil, before being immersed to a depth of about three inches in the test formulation, which was maintained at a controlled temperature of 90° F., for a stipulated length of time. The coupons were then removed from the formulations, flushed with running tap water, dipped in distilled water and observed for continuous wetting (water break-free). The coupons were returned to the bath as many times as necessary to obtain the water break-free condition. The results of this test are presented in Table III and the averaged results are graphically illustrated in FIG. 1. Except for formulations 1 and 6, each formulation was tested in duplicate to insure the accuracy of the results. Formulation 1 was tested in triplicate due to the large discrepancy between the results of the first two tests. Formulation 6 was only tested once due to the fact that it was an unoxidized formulation which was not expected to perform any better as a cleaner than was indicated by the result of the first test.

TABLE III

| Test # | Side of Coupon | Formulation Number 1 | 2 | 3 | 4 | 5 | 6 |
|---|---|---|---|---|---|---|---|
| 1 | A[a] | 30 s[b] | 30 s | 30 s | 60 s | 30 s | 180 s |
| 1 | B | 30 s | 30 s | 30 s | 60 s | 30 s | 180 s |
| 2 | A | 180 s | 30 s | 30 s | 60 s | 60 s | — |
| 2 | B | 180 s | 60 s | 30 s | 60 s | 60 s | — |
| 3 | A | 240 s | — | — | — | — | — |
| 3 | B | 360 s | — | — | — | — | — |
| Average Time | | 170 s | 37.5 s | 30 s | 60 s | 45 s | 180 s |
| SPOE/TPOE | | 100:0 | 80:20 | 60:40 | 40:60 | 20:80 | 0:100 |

[a]Each coupon possessed a finished side (A) and an unfinished side (B)
[b]Water break-free time in seconds The test data presented in Table III demonstrates that a cleaning composition comprising a mixture of an alkyl polyoxyalkylene sulfide and an alkyl polyoxyalkylene sulfoxide is a better cleaner than similar cleaning compositions which comprise only the alkyl polyoxyalkylene sulfide or the alkyl polyoxyalkylene sulfoxide alone. The data also shows that the cleaning composition comprising this mixture in a ratio of 60% sulfoxide to 40% sulfide is again preferred as the most effective cleaner.

Furthermore, based upon this data, it is believed that the cleaning composition comprising a mixture of an alkyl polyoxyalkylene sulfide and an alkyl polyoxyalkylene sulfoxide in a ratio of 20% sulfoxide to 80% sulfide (Formulation #5) is a better industrial cleaner than those cleaning compositions comprising only the alkyl polyoxyalkylene sulfide (Formulation #6) or the alkyl polyoxyalkylene sulfoxide (Formulation #1), despite the contrary results of the subjective valve cover test as set forth in Table II.

EXAMPLE II

In this example, the process that was used to oxidize the t-dodecyl polyoxyethylene sulfide to the corresponding t-dodecyl polyoxyethylene sulfoxide is described. In this process, droplets of a catalytic acid were added to about 0.25 moles of the sulfide until the initial pH of the sulfide was lowered to a desired level. The initial pH of the sulfide was altered in each test for the purpose of determining what effect the initial pH had on the oxidation reaction. Once the desired initial pH was reached, the resulting solution was charged into a 250 mL reaction flask which was equipped with an additive funnel, a reflux condenser, a mechanical stirrer and an argon bubbler. The solution was then heated, while being stirred, to a reaction temperature of about 150° F. Upon reaching this temperature, a predetermined amount of hydrogen peroxide was then added in the form of droplets to the solution. The amount of hydrogen peroxide to be added to the solution was governed by the desired degree of oxidation and was measured in terms of a percentage of stochiometric. Once the predetermined amount of hydrogen peroxide had been added to the solution, an exothermic reaction took place and the increasing temperature of the solution was observed to determine when the reaction peaked. After the temperature of the solution reached its peak, testing of the solution for the presence of remaining hydrogen peroxide was begun. Lead acetate test paper which had been treated with hydrogen sulfide was used for this determination. If the test paper was bleached white upon coming in contact with the solution then an amount of hydrogen peroxide was still present in the solution. If, however, the color of the test paper remained unchanged, then the hydrogen peroxide had been entirely consumed by the oxidation reaction and the reaction was complete. Testing for the presence of hydrogen peroxide in the solution was continued over a period of time until the testing indicated that no hydrogen peroxide remained.

EXAMPLE IIA

This example illustrates the results of tests which were performed upon oxidized solutions that were prepared in accordance with the oxidation process described in Example II. A portion of the oxidized solution was added to water to form a substantially clear, 1.0 weight-% aqueous solution. The aqueous solution was then heated for the purpose of determining the solution's cloud point. In addition, the final pH of the aqueous solution was determined. The remainder of the oxidized solution was then placed into an oven, which was maintained at a constant temperature of 140° F., for the purpose of measuring how long it would take the solution to decompose and form an oil layer. The results of these tests are presented in Table IV.

TABLE IV

| Test # | Acid | pHi[a] | pHf[b] 1% Soln. | Cloud Pt. 1% Soln. | % $H_2O_2$[c] | Days to Oil Formation |
|---|---|---|---|---|---|---|
| 1 | sulfuric | 6.33 | — | 155 | 150 | 0 |
| 2 | hydrochloric | 0.15 | 3.13 | 140 | 100 | 3 |
| 3 | acetic | 6.56 | 3.17 | 134 | 100 | 5 |
| 4 | acetic | 7.05 | 3.22 | 139 | 100 | 4 |
| 5 | acetic | 6.99 | 3.38 | 135 | 100 | 5 |
| 6 | acetic | 5.92 | 3.14 | 134 | 100 | 4 |
| 7 | acetic | 6.99 | 3.38 | 133 | 100 | 4 |
| 8 | sulfuric | 6.63 | — | 152 | 100 | 2 |
| 9 | sulfuric | 3.89 | — | 130 | 90 | 3 |
| 10 | sulfuric | 3.39 | — | 106 | 80 | 5 |
| 11 | sulfuric | 4.29 | 3.62 | 90 | 70 | 10 |
| 12 | sulfuric | 4.13 | — | 80 | 60 | 21 |
| 13 | sulfuric | 4.10 | 3.70 | NA[d] | 50 | 34+[e] |
| 14 | sulfuric | 1.40 | — | 147 | 100 | 2 |
| 15 | sulfuric | 0.45 | — | 134 | 90 | 3 |
| 16 | sulfuric | 0.51 | 3.43 | 110 | 80 | 4 |
| 17 | sulfuric | 0.15 | 3.63 | 101 | 70 | 14 |
| 18 | sulfuric | 0.29 | — | NA | 60 | 17 |
| 19 | sulfuric | 0.48 | — | NA | 50 | 32+[f] |

Figure 2:
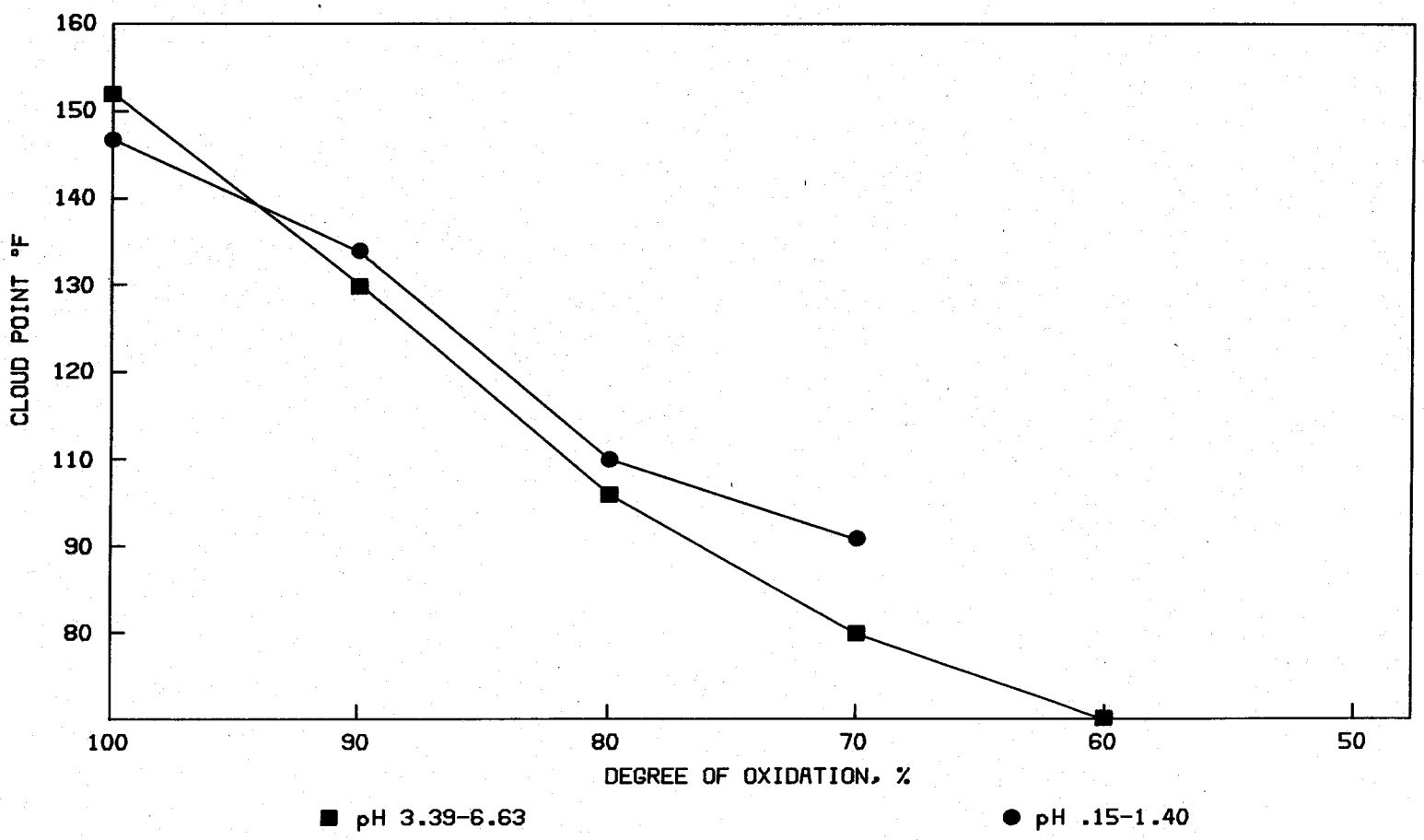
FIG. 2 is a graphical presentation of data from Example IIA which demonstrates the correlation between a solution's cloud point temperature and degree of oxidation.

[a]pH initial; pH of the sulfide prior to oxidation
[b]pH final; pH of the 1.0 weight % aqueous solution
[c]% of stochiometric; indicative of the degree of oxidation
[d]The solution's cloud point was below room temperature
[e]The test was stopped after 34 days with no sign of oil formation
[f]The test was stopped after 32 days with no sign of oil formation The test data presented in Table IV illustrates several things. First, it can be seen by comparing the results from runs 8–19 that a solution's cloud point is directly related to the solution's degree of oxidation; with a higher cloud point representing a higher degree of oxidation. These results are graphically illustrated in FIG. 2.

Secondly, by using the prior observation when comparing the results of runs 2, 3–7, 8 and 14, it can be seen that sulfuric acid produces a greater degree of oxidation, as represented by a higher cloud point temperature, than does either acetic acid or hydrochloric acid and is thus preferred as the more effective catalytic acid.

Finally, by comparing the results from runs 8–19, which are illustrated graphically in FIG. 3, it can be seen that as the degree of oxidation of the solutions decreases, the stability of the solutions, as represented by the number of days to oil formation in a heated oven, increases. It is believed that the increasing amount of said sulfide remaining in those solutions with lesser degrees of oxidation acts to improve the stability of the cleaning solution. Thus, a cleaning composition additive comprising a mixture of an alkyl polyoxyalkylene sulfide and an alkyl polyoxyalkylene sulfoxide is an ly more stable cleaning additive than a similar cleaning additive which comprises only the alkyl polyoxyalkylene sulfoxide.

EXAMPLE IIB

In this example, some of the solutions prepared in accordance with the process of Example II were tested in a nuclear magnetic resonance test (NMR) to determine the actual degree of oxidation of the solutions. The results of these tests were then compared with the theoretical degree of oxidation of the solutions. The theoretical degree of oxidation of each solution was determined by the amount of hydrogen peroxide, measured as a percentage of stochiometric, that was added to the oxidation reaction of that solution. The comparative results are presented in Table V and are graphically illustrated in FIG. 4.

TABLE V

| Test #[a] | % $H_2O_2$[b] | % Oxidation[c] |
|---|---|---|
| 14 | 100 | 97 |
| 15 | 90 | 80 |
| 16 | 80 | 75 |
| 17 | 70 | 66 |
| 18 | 60 | 58 |
| 19 | 50 | 48 |

[a]These test numbers correspond with those presented in Table IV
[b]% of stochiometric
[c]As determined by NMR analysis The test data presented in Table V demonstrates that the actual degree of oxidation of a solution which is prepared in accordance with the methods of Example II closely corresponds with the amount of hydrogen peroxide added to the oxidation reaction, said amount being measured in terms of % of stochiometric. Thus, the degree of oxidation may be controlled by altering the amount of hydrogen peroxide added to the oxidation reaction.

While this invention has been described in detail for the purpose of illustration, it is not to be construed as limited thereby but is intended to cover all changes and modifications within the spirit and scope thereof.

That which is claimed is:

1. A cleaning composition comprising a mixture of an alkyl polyoxyalkylene sulfide and an alkyl polyoxyalkylene sulfoxide, wherein the concentration of said alkyl polyoxyalkylene sulfide in said mixture is in the range of about 20 weight-% to about 80 weight-% based upon the weight of said mixture.

2. A cleaning composition in accordance with claim 1 wherein said alkyl polyoxyalkylene sulfide has the generic formula:

$$R—S—(R'O)_x—H$$

wherein R is a hydrocarbyl group having 1 to 20 carbon atoms, R' is a hydrocarbyl group having 2 to 5 carbon atoms and x=1 to 15.

3. A cleaning composition in accordance with claim 2 wherein R is a hydrocarbyl group having 12 carbon atoms, R' is a hydrocarbyl group having 2 carbon atoms and x=3 to 12.

4. A cleaning composition in accordance with claim 1 wherein said alkyl polyoxyalkylene sulfoxide has the generic formula:

$$R—\overset{\overset{\displaystyle O}{\|}}{S}—(R'O)_x—H$$

wherein R is a hydrocarbyl group having 1 to 20 carbon atoms, R' is a hydrocarbyl group having 2 to 5 carbon atoms and x=1 to 15.

5. A cleaning composition in accordance with claim 4 wherein R is a hydrocarbyl group having 12 carbon atoms, R' is a hydrocarbyl group having 2 carbon atoms and x=3 to 12.

6. A cleaning composition in accordance with claim 1 wherein said concentration is about 40 weight-% based upon the weight of said mixture.

7. A cleaning composition in accordance with claim 1 further comprising water and at least one builder selected from the group consisting of alkali metal and ammonium salts of ethylenediamine tetraacetic acid, alkali metal and ammonium pyrophosphates, alkali metal and ammonium metasilicates, alkali metal hydroxides, alkaline earth metal hydroxides and alkali metal borates.

8. A cleaning composition in accordance with claim 7 wherein the concentration of said mixture in said cleaning composition is in the range of about 1.0 weight-% to about 20 weight-% based upon the weight of said cleaning composition.

9. A cleaning composition in accordance with claim 8 wherein said concentration is in the range of about 5.0 weight-% to about 10 weight-% based upon the weight of said cleaning composition.

10. A cleaning composition in accordance with claim 7 wherein said builder is the sodium salt of ethylenediamine tetraacetic acid.

11. A cleaning composition in accordance with claim 7 wherein the concentration of said builder in said cleaning composition is in the range of about 1.0 weight-% to about 10 weight-% based upon the weight of said cleaning composition.

12. A cleaning composition in accordance with claim 11 wherein said concentration is in the range of about 2.0 weight-% to about 4.0 weight-% based upon the weight of said cleaning composition.

13. A cleaning composition in accordance with claim 1 further comprising at least one additive selected from the group consisting of perfumes, dyes, corrosion inhibitors, rust inhibitors, soil redeposition agents and water soluble surfactants.

14. A cleaning composition in accordance with claim 13 wherein said additive is a rust inhibitor.

15. A process for cleaning contaminated surfaces comprising the step of contacting said contaminated surfaces with a cleaning composition comprising a mixture of an alkyl polyoxyalkylene sulfide and an alkyl polyoxyalkylene sulfoxide, wherein the concentration of said alkyl polyoxyalkylene sulfide in said mixture is in the range of about 20 weight-% to about 80 weight-% based upon the weight of said mixture.

16. A process in accordance with claim 15 wherein said contaminated surfaces are contacted with said cleaning composition in a soak type bath.

17. A process in accordance with claim 15 wherein said contaminated surfaces are contacted with said cleaning composition by spraying said cleaning composition onto said contaminated surfaces.

18. A process in accordance with claim 15 wherein said alkyl polyoxyalkylene sulfide has the generic formula:

$$R—S—(R'O)_x—H$$

wherein R is a hydrocarbyl group having 1 to 20 carbon atoms, R' is a hydrocarbyl group having 2 to 5 carbon atoms and x=1 to 15.

19. A process in accordance with claim 18 wherein R is a hydrocarbyl group having 12 carbon atoms, R' is a hydrocarbyl group having 2 carbon atoms and x=3 to 12.

20. A process in accordance with claim 15 wherein said alkyl polyoxyalkylene sulfoxide has the generic formula:

$$R—\overset{O}{\overset{\|}{S}}—(R'O)_x—H$$

wherein R is a hydrocarbyl group having 1 to 20 carbon atoms, R' is a hydrocarbyl group having 2 to 5 carbon atoms and x=1 to 15.

21. A process in accordance with claim 20, wherein R is a hydrocarbyl group having 12 carbon atoms, R' is a hydrocarbyl group having 2 carbon atoms and x=3 to 12.

22. A process in accordance with claim 15 wherein said concentration is about 40 weight-% based upon the weight of said mixture.

23. A process in accordance with claim 15 wherein said cleaning composition further comprises water and at least one builder selected from the group consisting of alkali metal and ammonium salts of ethylenediamine tetraacetic acid, alkali metal and ammonium pyrophosphates, alkali metal and ammonium metasilicates, alkali metal hydroxides, alkaline earth metal hydroxides and alkali metal borates.

24. A process in accordance with claim 23 wherein the concentration of said mixture in said cleaning composition is in the range of about 5.0 weight-% to about 10 weight-% based upon the weight of said cleaning composition.

25. A process in accordance with claim 23 wherein said builder is the sodium salt of ethylenediamine tetraacetic acid.

26. A process in accordance with claim 23 wherein the concentration of said builder in said cleaning composition is in the range of about 2.0 weight-% to about 4.0 weight-% based upon the weight of said cleaning composition.

27. A process in accordance with claim 15 wherein said cleaning composition further comprises at least one additive selected from the group consisting of perfumes, dyes, corrosion inhibitors, rust inhibitors, soil redeposition agents and water soluble surfactants.

28. A process in accordance with claim 27 wherein said additive is a rust inhibitor.

29. A process for improving the stability of a cleaning additive comprising the step of adding an alkyl polyoxyalkylene sulfide to said additive to form a mixture of said alkyl polyoxyalkylene sulfide and said additive, wherein said additive comprises an alkyl polyoxyalkylene sulfoxide.

30. A process in accordance with claim 29 wherein said alkyl polyoxyalkylene sulfide has the generic formula:

$$R—S—(R'O)_x—H$$

wherein R is a hydrocarbyl group having 1 to 20 carbon atoms, R' is a hydrocarbyl group having 2 to 5 carbon atoms and x=1 to 15.

31. A process in accordance with claim 30 wherein R is a hydrocarbyl group having 12 carbon atoms, R' is a hydrocarbyl group having 2 carbon atoms and x=3 to 12.

32. A process in accordance with claim 30 wherein said alkyl polyoxyalkylene sulfoxide has the generic formula:

$$R—\overset{O}{\overset{\|}{S}}—(R'O)_x—H$$

wherein R is a hydrocarbyl group having 1 to 20 carbon atoms, R' is a hydrocarbyl group having 2 to 5 carbon atoms and x=1 to 15.

33. A process in accordance with claim 32 wherein R is a hydrocarbyl group having 12 carbon atoms, R' is a hydrocarbyl group having 2 carbon atoms and x=3 to 12.

34. A process in accordance with claim 29 wherein a sufficient amount of said alkyl polyoxyalkylene sulfide is added to said cleaning additive to result in a concentration of said alkyl polyoxyalkylene sulfide in said mixture in the range of about 20 weight-% to about 80 weight-% based upon the weight of said mixture.

35. A process in accordance with claim 34 wherein said concentration is about 40 weight-% based upon the weight of said mixture.

36. A process for preparing a cleaning composition comprising the step of forming a mixture of an alkyl polyoxyalkylene sulfide and an alkyl polyoxyalkylene sulfoxide by partially oxidizing said alkyl polyoxyalkylene sulfide to said alkyl polyoxyalkylene sulfoxide, wherein said partial oxidation results in a concentration of said alkyl polyoxyalkylene sulfide in said mixture in the range of about 20 weight-% to about 80 weight-% based upon the weight of said mixture.

37. A process in accordance with claim 36 wherein said alkyl polyoxyalkylene sulfide has the generic formula:

$$R—S—(R'O)_x—H$$

wherein R is a hydrocarbyl group having 1 to 20 carbon atoms, R′ is a hydrocarbyl group having 2 to 5 carbon atoms and x=1 to 15.

38. A process in accordance with claim 37 wherein R is a hydrocarbyl group having 12 carbon atoms, R′ is a hydrocarbyl group having 2 carbon atoms and x=3 to 12.

39. A process in accordance with claim 36 wherein said alkyl polyoxyalkylene sulfoxide has the generic formula:

$$R-\overset{\overset{\displaystyle O}{\|}}{S}-(R'O)_x-H$$

wherein R is a hydrocarbyl group having 1 to 20 carbon atoms, R′ is a hydrocarbyl group having 2 to 5 carbon atoms and x=1 to 15.

40. A process in accordance with claim 39 wherein R is a hydrocarbyl group having 12 carbon atoms, R′ is a hydrocarbyl group having 2 carbon atoms and x=3 to 12.

41. A process in accordance with claim 36 wherein said partial oxidation is accomplished by contacting said alkyl polyoxyalkylene sulfide at a pH less than seven (7) with an oxidizing agent and a catalytic acid under suitable oxidizing conditions.

42. A process in accordance with claim 41 wherein said oxidizing agent is hydrogen peroxide.

43. A process in accordance with claim 41 wherein said catalytic acid is sulfuric acid.

44. A process in accordance with claim 36 wherein said concentration is about 40 weight-%.

45. A process in accordance with claim 36 further comprising the step of combining said mixture with water and at least one builder selected from the group consisting of alkali metal and ammonium salts of ethylenediamine tetraacetic acid, alkali metal and ammonium pyrophosphates, alkali metal and ammonium metasilicates, alkali metal hydroxides, alkaline earth metal hydroxides and alkali metal borates to produce said cleaning composition.

46. A process in accordance with claim 45 wherein a sufficient amount of said mixture is combined with said builder and water to result in a concentration of said mixture in said cleaning composition in the range of about 5.0 weight-% to about 10 weight-% based upon the weight of said cleaning composition.

47. A process in accordance with claim 45 wherein said builder is the sodium salt of ethylenediamine tetraacetic acid.

48. A process in accordance with claim 45 wherein a sufficient amount of said builder is combined with said mixture and water to result in a concentration of said builder in said cleaning composition in the range of about 2.0 weight-% to about 4.0 weight-% based upon the weight of said cleaning composition.

49. A process in accordance with claim 45 further comprising the step of adding at least one additive selected from the group consisting of perfumes, dyes, corrosion inhibitors, rust inhibitors, soil redeposition agents and water soluble surfactants to said cleaning composition.

50. A process in accordance with claim 49 wherein said additive is a rust inhibitor.

* * * * *